US010220400B2

(12) United States Patent
Tada

(10) Patent No.: US 10,220,400 B2
(45) Date of Patent: Mar. 5, 2019

(54) PUSH PUMP DISPENSER

(71) Applicants: CANYON CORPORATION, Tokyo (JP); Mieko Tada

(72) Inventor: Tetsuya Tada, Tokyo (JP)

(73) Assignee: CANYON CORPORATION, Tokyo (JP)

( * ) Notice: Subject to any disclaimer, the term of this patent is extended or adjusted under 35 U.S.C. 154(b) by 0 days.

(21) Appl. No.: 15/512,801

(22) PCT Filed: Sep. 14, 2015

(86) PCT No.: PCT/JP2015/004672
§ 371 (c)(1),
(2) Date: Mar. 20, 2017

(87) PCT Pub. No.: WO2016/047086
PCT Pub. Date: Mar. 31, 2016

(65) Prior Publication Data

US 2017/0291184 A1 Oct. 12, 2017

(30) Foreign Application Priority Data

Sep. 22, 2014 (JP) ..... 2014-193125

(51) Int. Cl.
*B05B 11/00* (2006.01)
*F04B 9/14* (2006.01)
(Continued)

(52) U.S. Cl.
CPC ..... *B05B 11/3001* (2013.01); *B05B 11/3073* (2013.01); *B05B 15/63* (2018.02);
(Continued)

(58) Field of Classification Search
CPC ..... B05B 11/3001; B05B 11/3073; B05B 11/3077; B05B 11/3067; B05B 11/3011;
(Continued)

(56) References Cited

U.S. PATENT DOCUMENTS 1,937,344 A * 11/1933 Hollingsworth .... B05B 11/3009 222/385
2,185,534 A * 1/1940 Bernhardt ..... B05B 11/3001 222/321.9
(Continued)

FOREIGN PATENT DOCUMENTS

EP 2172275 A1 4/2010
EP 3042725 A1 7/2016
(Continued)

OTHER PUBLICATIONS

The extended European search report of EP application No. 15/845083.3 dated Apr. 20, 2018.
(Continued)

*Primary Examiner* — Frederick C Nicolas
(74) *Attorney, Agent, or Firm* — Muncy, Geissler, Olds & Lowe, P.C.

(57) ABSTRACT

A push pump dispenser injects liquid within a cylinder portion from a nozzle portion by pushing down the finger putting portion located above a grip portion in a state where the grip portion has been grasped by a user. A finger abutting portion of the grip portion is located behind a power point of the finger putting portion.

7 Claims, 11 Drawing Sheets

(51) Int. Cl.
*B05B 15/63* (2018.01)
*B05B 15/30* (2018.01)

(52) U.S. Cl.
CPC ..... *F04B 9/14* (2013.01); *B05B 11/0075* (2013.01); *B05B 11/304* (2013.01); *B05B 11/3011* (2013.01); *B05B 11/3045* (2013.01); *B05B 11/3047* (2013.01); *B05B 11/3059* (2013.01); *B05B 11/3067* (2013.01); *B05B 11/3077* (2013.01); *B05B 15/30* (2018.02)

(58) Field of Classification Search
CPC ... B05B 11/3045; B05B 15/30; B05B 15/005; B05B 11/3059; B05B 11/3047; B05B 11/304; B05B 15/63; B05B 11/0075; F04B 9/14
See application file for complete search history.

(56) References Cited

U.S. PATENT DOCUMENTS 2,796,244 A * 6/1957 Gonski ..... E21C 27/124 198/518
3,478,935 A * 11/1969 Brooks ..... B05B 11/3057 222/321.8
4,061,250 A * 12/1977 Tada ..... B05B 11/0016 222/321.8
4,124,148 A * 11/1978 Vieler ..... B05B 11/3052 222/321.8
4,186,855 A * 2/1980 Edman ..... B05B 11/3057 222/321.8
5,219,098 A * 6/1993 Tada ..... B05B 11/3001 222/153.06
6,932,247 B2 * 8/2005 Clerget ..... B05B 11/0043 222/105
9,789,503 B2 * 10/2017 Tada ..... B05B 11/0067
2007/0157368 A1 * 7/2007 James ..... A41B 11/001 2/239
2010/0127020 A1 5/2010 Tada
2010/0276454 A1 * 11/2010 Espinoza ..... B05B 11/3011 222/153.13
2011/0284578 A1 * 11/2011 Wong ..... A47G 19/183 222/40
2014/0061252 A1 * 3/2014 Sweeton ..... B05B 11/0037 222/321.8
2016/0193617 A1 * 7/2016 Tada ..... B05B 11/0067 222/324

FOREIGN PATENT DOCUMENTS

JP 56265 7/1993
JP 2006-521978 A 9/2006
JP 2008087808 A * 4/2008 ..... B05B 11/00
JP 2009-22935 A 2/2009
JP 2010-269553 A 12/2010
JP 2013-112382 A 6/2013
WO 2005072880 A1 8/2005

OTHER PUBLICATIONS

International Search Report from corresponding PCT application No. PCT/JP2015/004672.

* cited by examiner

| Angle θ | 1 | 2 | 3 | 4 | 5 | 6 | 7 | 8 | 9 | 10 | 11 | 12 |
|---|---|---|---|---|---|---|---|---|---|---|---|---|
| ◎ | 6 | 12 | 16 | 18 | 20 | 17 | 17 | 16 | 15 | 13 | 9 | 8 |
| ○ | 10 | 10 | 13 | 12 | 13 | 13 | 12 | 13 | 12 | 12 | 9 | 8 |
| △ | 9 | 9 | 5 | 5 | 5 | 7 | 5 | 6 | 9 | 8 | 10 | 11 |
| □ | 12 | 8 | 5 | 5 | 3 | 4 | 6 | 5 | 5 | 7 | 11 | 11 |
| × | 6 | 4 | 4 | 3 | 2 | 2 | 3 | 3 | 2 | 3 | 4 | 5 |
| Total | 43 | 43 | 43 | 43 | 43 | 43 | 43 | 43 | 43 | 43 | 43 | 43 |

PUSH PUMP DISPENSER

TECHNICAL FIELD

The present invention relates to a pump dispenser that is attached to a container to inject liquid received in the container efficiently, and more specifically to a push-type pump dispenser for forming an injecting pressure by pushing down a nozzle head located above a grip.

BACKGROUND ART

Currently, a pump dispenser is widely used as an instrument which is attached to a container for injecting (or discharging) liquid in the container.

A conventional pump dispenser is ordinarily provided with a piston and a cylinder, and is configured such that a pressure is applied to inside of the cylinder according to movement of the piston so that liquid is injected.

The conventional pump dispenser is classified into either of types according to how to move the piston, and there is, for example, a trigger-type pump dispenser having such a form that a trigger is pulled in by user's four fingers as one of the types (see PTL1 and PTL2).

An operation lever corresponding to the trigger is provided in front of each of these trigger-type pump dispenser, where when a user grasps the operation lever with the user's hand to move the operation lever to a near side of the user, the piston arranged so as to extend in a left-right direction moves in linkage with the movement of the operation lever so that a liquid pressure within the cylinder is raised.

As a result, liquid is vigorously injected from a nozzle.

CITATION LIST

Patent Literature

PTL 1: Japanese Patent Application Laid-Open No. 2008-229445

PTL 2: Japanese Patent Application Laid-Open No. 2012-176379

PTL 3: Japanese Patent Application Laid-Open No. 2010-184182

SUMMARY OF INVENTION

Technical Problem

Now, in such a trigger-type pump dispenser as described above, when the user pulls in the trigger, the user must grasp a whole periphery of the trigger-type pump dispenser with the user's palm and must pull in the trigger in a lateral direction by using the user's finger.

Therefore, when a child with small hands, an aged person with a lowered grasping force or finger force, a physically handicapped person, or the like handles the trigger-type pump dispenser, a state where such a user grasps the trigger becomes shallow and it becomes difficult for the user to put muscle into the trigger.

Further, since the user grasps the whole trigger-type pump dispenser with four (or two or three according to a person) fingers, when liquid agent or the like adheres to the periphery of a pump dispenser main body, there is such a disadvantage that the liquid agent or the like adheres the user's hand, which results in dirt. Especially, the user's finger located just below the nozzle is prone to become stain.

In order to solve such a problem, a trigger-type pump dispenser having such a structure that, by providing a grip just below a trigger, a user can grasp the trigger and the grip simultaneously to push the trigger downward has been developed (see PTL3).

The trigger-type pump dispenser is configured to be operated such that a user supports the grip portion located on a rear side with the user's four fingers and puts the user's thumb on the trigger to push down the trigger, and because it can be used in such a state that the thumb extends upward, an excellent operability can be obtained.

Therefore, the trigger-type pump dispenser can be simply handled by a child or the like and it has considerably high usability.

However, since the user rotationally operates the trigger by using a lever, the thumb used for pushing down the trigger requires an arc-shaped motion, which results in unnaturalness in the motion of the thumb.

In view of these circumstances, a pump dispenser further easy to use is desired from the viewpoint of human engineering.

The present invention has been made based upon such a background art, and it has been made in order to overcome the problems of the above-described background art.

That is, an object of the present invention is to provide a push-type pump dispenser where transmission of a user's finger force is efficient and operability is excellent in a pump dispenser having a form of transmitting a force to a piston within a pump linearly to inject liquid.

Solution to Problems

As the result that the present inventor has keenly held a series of studies about such a problem and a background, the inventor has found such a point that in a pump dispenser where an injecting pressure can be formed by pushing down a nozzle head, by paying attention to a mutual positional relationship between a grip and the nozzle head and expanding a region of the nozzle head to overhang the same to the side of a grip portion and utilize the overhung portion as a finger abutting portion, operability can be further improved, and has completed the present invention based upon this finding.

The present invention lies in (1) that in a push-type pump dispenser that discharges liquid within a cylinder portion from a nozzle head portion by pushing down the nozzle head portion located above a grip portion in a state where the grip portion has been grasped by a user, wherein a finger abutting portion of the grip portion is located behind a power point of the nozzle head portion.

The present invention lies in (2) the push-type pump dispenser according in the above item (1), wherein the grip portion is formed in an L shape, and an inclination angle of the finger abutting portion is in a range from 3° to 10°.

The present invention lies in (3) the push-type pump dispenser according in the above item (1) including a cylinder portion and the grip portion attached to the cylinder portion, a piston portion slidable within the cylinder portion, a piston shaft portion attached to the piston portion, a nozzle head portion attached to the piston shaft portion, a spring portion for causing the cylinder portion to return, a cap portion for attaching the cylinder portion to the container, a first valve, and second valve, wherein the nozzle head portion has a nozzle portion in front thereof and includes a finger putting portion largely extending backward, the grip portion has a cylindrical base portion in which the piston shaft portion is inserted to be guided, and the piston portion is moved to apply a pressure to inside of the cylinder portion to discharge liquid through the nozzle portion by pulling down the finger putting portion of the nozzle head portion to cause the finger putting portion to come close to the grip portion.

The present invention lies in (4) the push-type pump dispenser according in the above item (3), wherein the piston shaft portion has a rib portion in an axial direction thereof, and a vertically long groove portion fitted with the rib portion is provided in the cylindrical base portion of the grip portion.

The present invention lies in (5) the push-type pump dispenser according in the above item (3), wherein an upper portion of the piston shaft portion is attached to the nozzle head by press fitting into the nozzle head portion, and an upper portion of the cylinder portion is attached to the grip portion by press fitting into the grip portion.

The present invention lies in (6) the push-type pump dispenser according in the above item (3), wherein the magnification of a length (L) of the cylindrical base portion of the grip portion to an outer diameter (R) of the piston shaft portion is in a range of 1 to 3.

The present invention lies in (7) the push-type pump dispenser according in the above item (3), wherein the cylindrical base portion has a cylindrical space portion for providing an elastic property.

The present invention lies in (8) the push-type pump dispenser according in the above item (3), wherein the grip portion has a circular shape.

The present invention lies in (9) a push-type pump dispenser that discharges liquid within a cylinder portion from a nozzle head portion by pushing down the nozzle head portion located above a grip portion in a state where the grip portion integrally provided on a container has been grasped by a user, wherein a finger abutting portion of the grip portion is located behind a power point of the nozzle head portion.

The present invention lies in (10) the push-type pump dispenser according to the item (9), wherein the grip portion is formed in an L shape, and an inclination angle of the finger abutting portion of the grip portion is in a range from 3° to 10°.

The present invention lies in (11) the push-type pump dispenser according to the item (9) including the cylinder portion and a piston guiding cylindrical portion (corresponding to the [cylindrical base portion] in claim 3) attached to the cylinder portion, a piston portion slidable within the cylinder portion, a piston shaft portion attached to the piston portion, a nozzle head portion attached to the piston shaft portion, a spring portion for causing the cylinder portion to return, a cap portion for attaching the cylinder portion to the container, a grip portion integrally provided on the container, a first valve, and a second valve, wherein the nozzle head portion has a nozzle portion in front thereof and includes a finger putting portion largely extending backward, and the piston portion is moved to apply a pressure to inside of the cylinder portion to discharge liquid through the nozzle portion by pulling down the nozzle head portion to cause the nozzle head portion to come close to the grip portion.

It should be noted that a configuration obtained by combining the contents of the above items (1) to (11) properly can be also adopted when the configuration achieves the object of the present invention.

Advantageous Effects of Invention

Since the present invention relates to the push-type pump dispenser that injects liquid within the cylinder portion from the nozzle portion by pushing down the nozzle head portion located above a grip portion in a state where the grip portion has been grasped by a user, wherein a finger abutting portion of the grip portion is located behind a power point of the nozzle head portion, an efficient transmission of a finger force is achieved, and an excellent operability is obtained.

Further, since the grip portion is formed in an L shape and the inclination angle of the finger abutting portion is in a range of 3° to 10°, the user is prone to support the gravity and the user's gripping force increases.

Therefore, the present invention can also be applied to a push-type pump dispenser having a heavy container.

DESCRIPTION OF EMBODIMENTS

Figure 1:
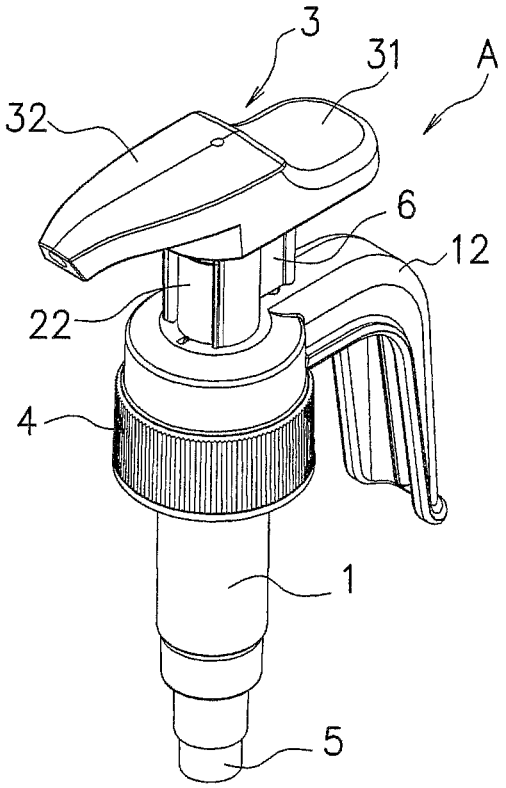
FIG. 1 is a perspective view showing a push-type pump dispenser of the present invention.

Preferred embodiments of the present invention will be explained below in detail with reference to the drawings as necessary.

It should be noted that same reference signs are attached to same elements in the drawings so that repetitive explanation is omitted.

Further, a positional relationship such as up and down, left and right, or the like is based upon a positional relationship shown in the figures unless otherwise noted.

Furthermore, a size ratio in the figures is not limited to the ratio illustrated.

First Embodiment

A push-type pump dispenser A of the present invention has a structure where a user lowers a piston portion 21 and applies pressure to liquid to inject the same from a nozzle portion 32 by grasping a grip portion 12 and putting the user's finger on a finger putting portion 31 which is an extended region of a nozzle head portion 3 to push down (namely, pull down) the finger putting portion 31.

It should be noted that transmission of the downward-pushing force is directly performed to the piston portion without intervention of a lever.

Figure 2:
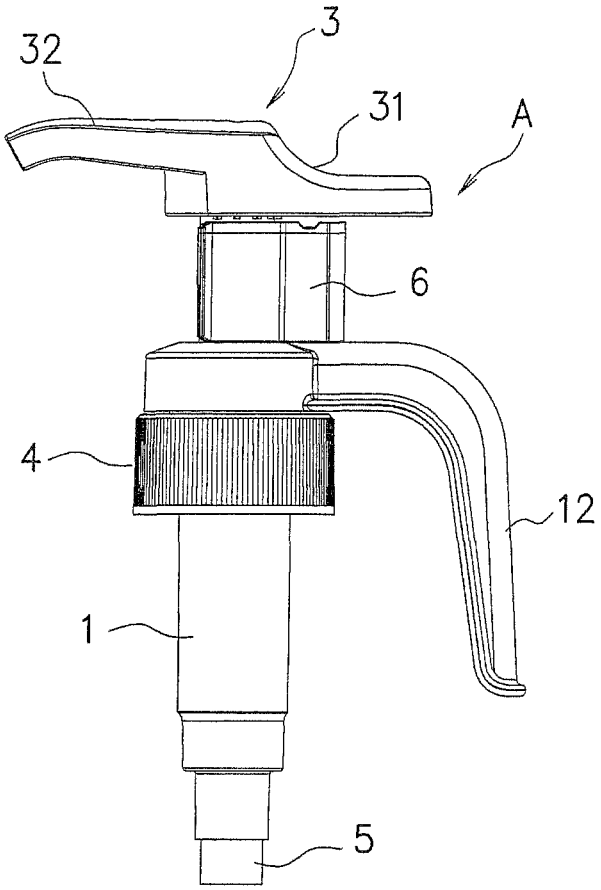
FIG. 2 is a side view showing the push-type pump dispenser of the present invention.

FIG. 1 is a perspective view showing the push-type pump dispenser A of the present invention, and FIG. 2 is a side view showing the push-type pump dispenser A of the present invention.

Figure 3:
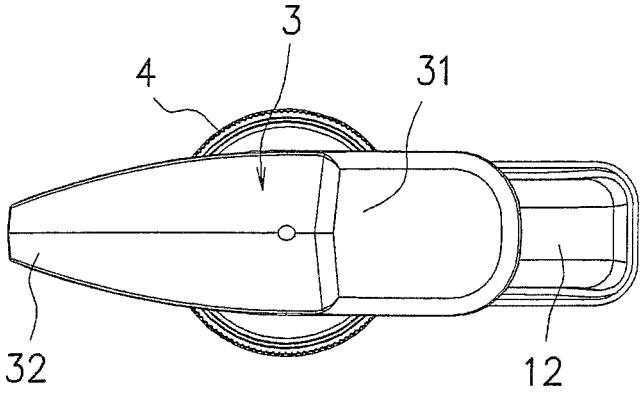
FIG. 3 is a plan view showing the push-type pump dispenser of the present invention.

Further, FIG. 3 is a plan view showing the push-type pump dispenser A of the present invention.

Figure 4:
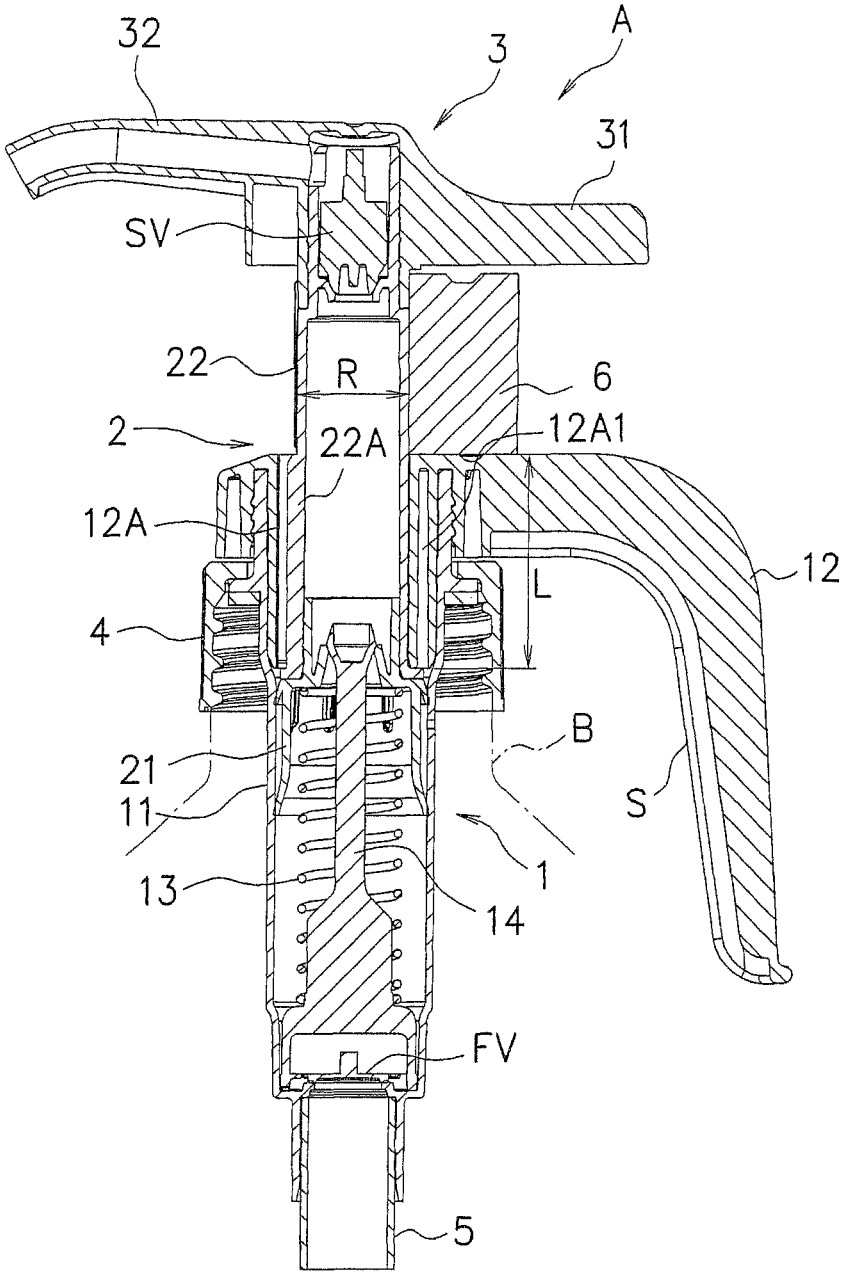
FIG. 4 is a sectional view showing a state of the push-type pump dispenser of the present invention before a user pushes down a finger putting portion.

Furthermore, FIG. 4 is a sectional view showing a state of the push-type pump dispenser A of the present invention before the finger putting portion 31 is pushed down.

It should be noted that FIG. 1 to FIG. 4 show a state of the push-type pump dispenser A of the present invention to which a stopper 6 has been attached, but the stopper itself is a member for maintaining the push-type pump dispenser A of the present invention so as not to inject liquid during transportation of the push-type pump dispenser A carelessly, and when the push-type pump dispenser A is used, the push-type pump dispenser A is used by removing the stopper 6.

The push-type pump dispenser A of the present invention is mainly provided with a cylinder structure 1, a piston structure 2, a nozzle head portion 3 (provided with a nozzle portion 32), a grip portion 12, and a cap portion 4.

(Cylinder Structure)

The cylinder structure 1 is provided with a cylinder portion 11, a first valve portion FV, and a spring portion 13.

The cylinder portion 11 is provided with the spring portion 13 inside, and an upper end of the spring portion 13 is attached to inside of the piston portion 21 described later, while a lower end thereof abuts on a leak valve 14.

The spring portion 13 is a member that is shortened to exert a return force when a piston shaft portion 22 is pushed down, and a coil spring is generally suitably used as the spring portion 13, but the spring portion 13 is not limited to the coil spring.

The piston portion 21 can be slid within the cylinder portion in a vertical direction by the return force of the spring portion 13 and the pushing-down of the piston shaft portion 22.

Moreover, an outer peripheral flange is formed on the cylinder portion 11, and the cylinder portion 11 is attached to a container B by pressing the flange by the cap portion 4 through a packing.

The cap portion 4 can be attached to a mouth portion of the container B, for example, by utilizing screwing or the like.

(Grip Portion)

The grip portion 12 includes a main feature point of the present invention.

The grip portion 12 is formed with a cylindrical base portion 12A on the opposite side to a grasping portion thereof, and the cylindrical base portion 12A is attached to an upper portion of the cylinder portion 11 by press fitting.

Figure 5:
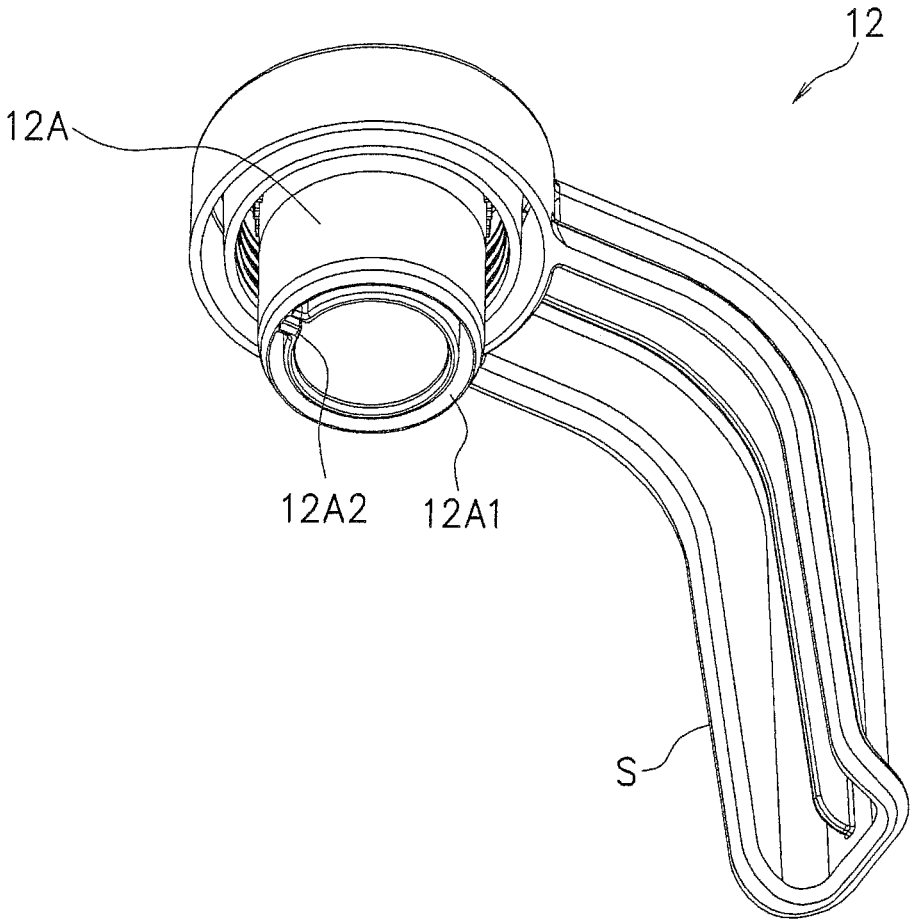
FIG. 5 is a perspective view of a grip portion as viewed from below.

FIG. 5 is a perspective view of the grip portion 12 as viewed from below.

As understood from FIG. 5, the cylindrical base portion 12A of the grip portion 12 is formed with a cylindrical space portion 12A1 and a vertically-long groove portion 12A2.

Among them, the cylindrical space portion 12A1 is a portion for providing an appropriate contact pressure in order to apply elastic force to the cylindrical base portion 12A when the piston shaft portion 22 moves vertically to contact with the cylindrical base portion 12A.

Furthermore, the vertically-long groove portion 12A2 is a portion for constituting a guide mechanism in cooperation with the piston shaft portion 22, and it will be described in detail later.

In addition, the first valve portion FV is integrally provided with a lower end of the leak valve portion 14, it has a structure having a valve portion and a spring portion, and detailed explanation thereof is omitted.

(Piston Structure)

On one hand, the piston structure 2 is provided with the piston portion 21, the piston shaft portion 22 for transmitting movement of the nozzle head portion 3 to the piston portion 21, and the second valve SV provided on the piston shaft portion 22.

Then, the nozzle head portion 3 is attached to an upper portion of the piston shaft portion 22 by press fitting.

It should be noted that, in this case, from the viewpoint of an attaching strength, as a length of a portion of the piston shaft portion 22 press-fitted into the nozzle head portion 3, a range of 1 to 3 times a fitting hole diameter of the nozzle head portion 3 is preferably adopted in a fitting relationship between the nozzle head portion 3 and the piston shaft portion 22.

Further, the nozzle head portion 3 is integrally formed with the nozzle portion 32 projecting forward, and liquid is injected from the nozzle portion 32.

The piston portion 21 is attached to the piston shaft portion 22 by press fitting, and both the portions are securely fixed to each other through a coming-off prevention portion so as not to falling off from each other.

The second valve portion SV is internally attached to the upper end portion of the piston shaft portion 22, namely, an attaching position with the nozzle head portion 3.

Now, as described above, the piston portion 21 slides within the cylinder portion, but the guide mechanism is provided between the piston shaft portion 22 moving the piston portion 21 and the cylindrical base portion 12A of the grip portion 12.

That is, the piston shaft portion 22 which is one of the piston shaft portion 22 and the cylindrical base portion 12A of the grip portion 12 is provided with a vertical rib portion 22A extending along an axial direction thereof, while the cylindrical base portion 12A of the grip portion 12 which is the other is provided with the vertically-long groove portion 12A2 fitted with the vertical rib portion 22A.

Since the vertical rib portion 22A of the piston shaft portion 22 slides in a state where the vertical rib portion 22A has been fitted into the vertically-long groove portion 12A2 of the cylindrical base portion 12A of the grip portion 12 due to presence of such a guide mechanism, the piston shaft portion 22 can move vertically without rotating.

Thereby, of course, the vertical movement of the piston portion 21 also becomes stable and smooth.

It should be noted that, since the cylindrical space portion 12A1 formed in the cylindrical base portion 12A is present, elastic abutment to the piston shaft portion 22 can be achieved, and the vertical movement of the piston shaft portion 22 is made more stable.

(Nozzle Head Portion)

The nozzle head portion 3 attached to the upper end portion of the piston shaft portion 22 is provided with a finger putting portion 31 extending largely backward.

That is, the finger putting portion 31 is formed so as to largely extend in a fixed region on a rear end portion of the nozzle head portion 3.

When a user puts the thumb to the finger putting portion 31 to push down the finger putting portion 31, a central position of the finger putting portion 31 constitutes a power point P1.

In such a structure, the power point P1 which is the central position of the finger putting portion 31 is set at a position in front of the finger abutting portion S of the grip portion 12 (feature 1).

When the user puts the thumb on the finger putting portion 31 to push down the finger putting portion 31, the user can precisely transmit the pressing to the piston shaft portion 22 to push down the same.

In addition, since the power point P1 is set at the intermediate position between a center axis of the cylinder portion 11 and the grip portion 12, the transmission of the pressing can be performed in a dynamically stable state.

It should be noted that many linear projections laterally extending can be formed on the finger putting portion 31, and in the case that such linear projections are formed, considerably effective transmission of a force can be achieved while the user's finger is prevented from rubbing, when the user pushes down the thumb.

Here, it is preferable that the magnification of a length (L) of the cylindrical base portion 12A of the grip portion 12 to an outer diameter (R) of the piston shaft portion 22 is in a range of 1 to 3.

By adopting such a configuration, such an effect can be obtained that stable vertical movement of the piston shaft portion 22 to the cylindrical base portion 12A can be achieved.

Further, it is preferable that the outer diameter (R) of the piston shaft portion 22 is in a range of 5 mm to 20 mm from the viewpoint of a motion stability to the cylindrical base portion 12A.

Further, it is preferable that a shape of the grip portion 12 is formed in an L shape, and an inclination angle of the finger abutting portion S is set in a range of 3° to 10°, but this point will be described in detail later.

As the push-type pump dispenser A of the present invention, it becomes possible for the user to put the thumb on the finger putting portion 31 of the nozzle head portion 3 in a state where the user has stood the thumb in a slightly forwardly-inclined fashion when the user has grasped the grip portion 12.

When the user pushes down the piston shaft portion 22, the user simply puts a plurality of fingers except for the thumb on the grip portion 12 to put the thumb on the finger putting portion 31 and push the thumb downward in a state where the user has grasped the grip portion 12 with these fingers.

That is, in this case, an efficient one-hand operation becomes possible.

Of course, such a two-hand operation is possible that, in a state where the user has grasped the grip portion 12 with one hand, the user pushes down the finger putting portion 31 with the other hand.

Since the grip portion 12 is provided, operation can be performed easily by utilizing the grip portion 12, and since the two-hand operation is also possible, the push-type pump dispenser A of the present invention can be simply handled by a child with small hands or the like.

Next, the operation of the push-type pump dispenser A will be described.

Figure 6A:
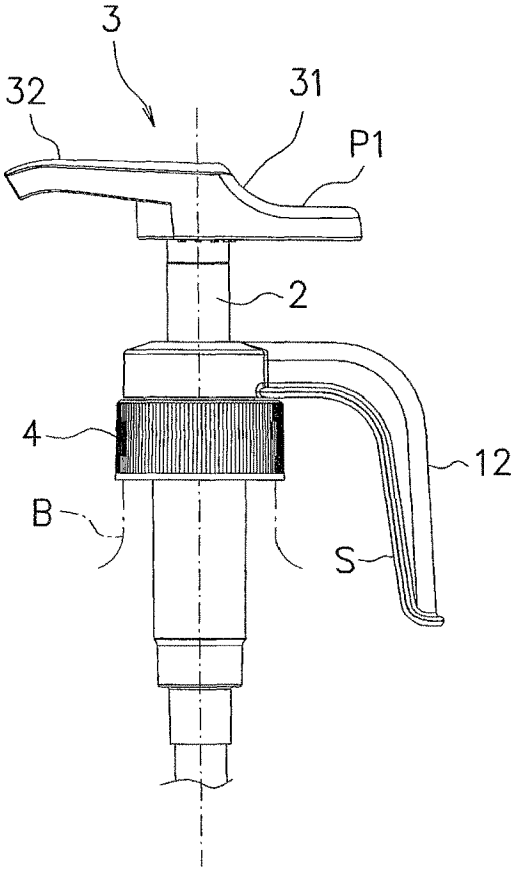
FIGS. 6*a* to 6*c* are views for explaining how to use the push-type pump dispenser of the present invention.
Figure 6B:
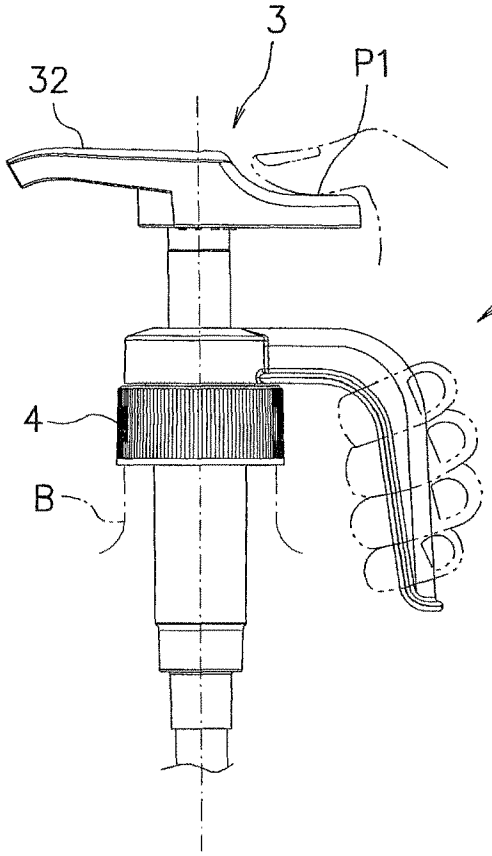
Figure 6C:
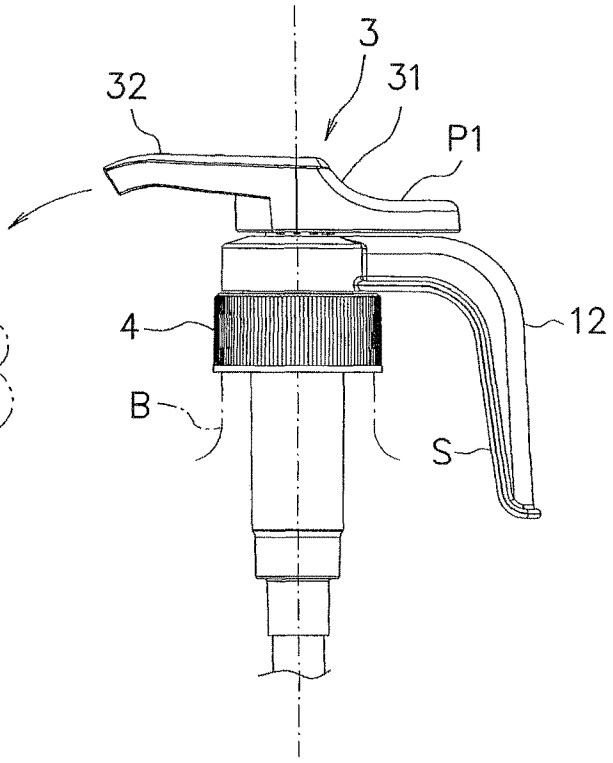
Figure 7:
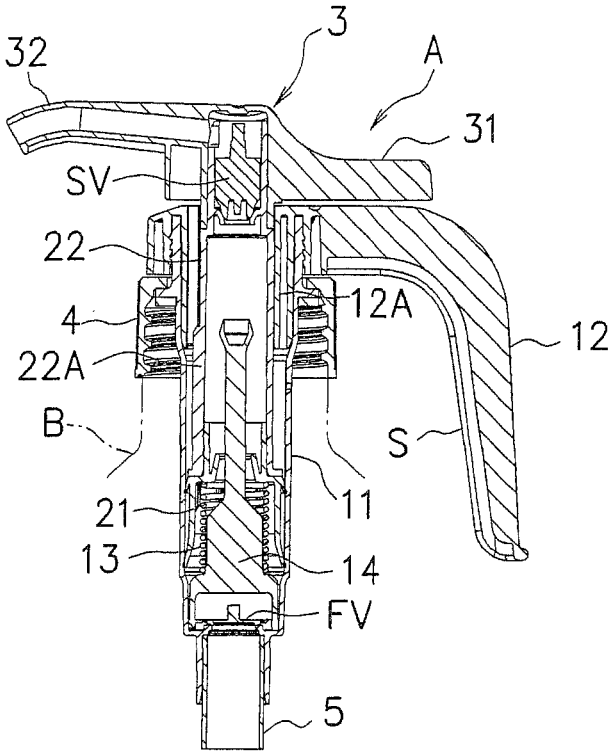
FIG. 7 is a sectional view of the push-type pump dispenser of the present invention after the finger putting portion has been pushed down.

FIGS. 6*a* to 6*c* are views for explaining how to use the push-type pump dispenser A of the present invention, and FIG. 7 is a sectional view of the push-type pump dispenser A of the present invention after the user has pushed down the finger putting portion 31.

FIG. 6A is a side view of the push-type pump dispenser A of the present invention before a user uses the same.

FIG. 6B is a side view showing a state where the user has grasped the grip portion 12 of the push-type pump dispenser A of the present invention with fingers except for the thumb and the user has put the thumb on the finger putting portion 31.

FIG. 6C is a side view showing a state where the user has performed pushing-down fashion lowering of the thumb which has been put on the finger putting portion 31 at a position of the power point P1 (the finger has been omitted).

Regarding the push-type pump dispenser A of the present invention at an initial position shown in FIG. 6A, the user puts a user's finger on the finger putting portion 31 to push down the position of the power point P1 directly.

Here, it is preferable that the position of the power point P1 is set at a position of 100 mm or less from the center axis of the cylinder portion 11, for example.

In this case, the position of inside of the grip portion 12 (the finger abutting portion S) is set at a position of 100 mm or more from the center axis of the cylinder portion 11.

When liquid pressure within the cylinder portion 11 rises, the second valve portion SV opens (the first valve FV is in a closed state), so that liquid within the cylinder portion 11 is discharged from the nozzle portion 32 of the nozzle head portion 3 (more specifically, the nozzle port).

In this case, the nozzle port lowers according to reception of the piston portion 21 into the cylinder portion 11, but since the lowering is coincident with the downward movement of the finger putting portion 31, it is easy to decide a target.

It should be noted that the finger putting portion 31 is pushed down so that a portion (not shown) thereof abuts on the grip portion 12 to stop, but this position is a bottom dead center of the finger putting portion 31.

Next, when the user releases the hand to release the pressing force from the finger putting portion 31, the piston shaft portion 22 is about to rise due to the return force of the spring portion 13 (see FIG. 4) provided in the cylinder portion 11 to return to its original position in the closed state of the second valve portion SV.

Therefore, the pressure within the cylinder portion 11 lowers, and the first valve portion FV opens (the second valve portion SV is in the closed state at this time), so that fresh liquid within a container main body is sucked up through a tube portion 5 to enter the cylinder portion 11.

An upward biasing force is always applied to the finger putting portion 31 by the spring portion 13, so that even if the user puts the thumb on the finger putting portion 31 to push down the finger putting portion 31 slightly, the finger putting portion 31 can return to the original position naturally when the user releases the thumb.

As described above, since the power point P1 is set at the intermediate position between the center axis of the cylinder portion 11 and the grip portion 12, the transmission of the pressing can be performed in a dynamically stable state.

It should be noted that, since the liquid within the container main body decreases, the inside of the container main body changes to a negative pressure so that a recess or the like occurs in the container or a liquid-raising action is blocked, but the push-type pump dispenser A is provided with a negative pressure cancellation means (not shown) for cancelling the negative pressure.

As described previously, in the push-type pump dispenser A of the present invention, since the grip portion 12 is located below the finger putting portion 31, when the user pushes down the finger putting portion 31 in order to inject liquid, the user is not required to grasp the whole pump dispenser.

As shown in FIGS. 6*a* to 6*c*, the user only puts the thumb on the power point P1 of the finger putting portion 31 to push down the finger putting portion 31 simply in a state where the user has put the user's four fingers (three fingers according to a person) on the grip portion 12.

Therefore, the push-type pump dispenser A can also be handled easily by a child with small hands, an aged person with a lowered grasping force, or the like.

In addition, even when liquid agent adheres to the pump dispenser itself, since the user's hand is in a spaced state apart from the pump dispenser main body, the user does not get dirty.

The grip portion 12 and the finger putting portion 31 of the nozzle head portion 3 have been described above, but the positional relationship therebetween will be further described.

In the grip portion 12 of the present invention, a portion of the grip portion 12 which fingers of a grasping user abuts on ("the finger abutting portion S") is inclined forward.

Since the finger abutting portion S is inclined forward in this manner, the thumb also inclines forward in a state where the user has grasped the grip portion 12 to put his/her fingers on the grip portion 12.

Since the thumb inclines forward, the user can easily put the thumb on the finger putting portion 31, and simultaneously it is made easy to push down the finger putting portion 31.

In addition, when the user grasps the grip portion 12, since a component force occurs due to the inclined surface of the finger abutting portion S so that the gravity of the push-type pump dispenser A is dispersed, it becomes easy for the user to support the push-type pump dispenser A, which results in increase in a gripping force.

Such a feature 2 is also effective in order to support the weight of the whole container including the push-type pump dispenser A.

Experiments regarding the validity of this point will be described later.

Further, in the present invention, the finger abutting portion S is entirely located behind (outside) the power point P1 of the finger putting portion 31 of the nozzle head portion 3.

Since the finger abutting portion S is located behind (outside) the power point P1, when the user grasps the grip portion 12 to put the thumb to the finger putting portion 31, the thumb become inclined forward, so that a pressing operation in a naturally bending direction of the thumb can be performed easily.

Therefore, no unnaturalness occurs in how to use the finger, so that efficient transmission of the finger force can be performed.

That is, specifically, the user inclines the thumb forward from a state where the user has grasped the grip portion 12 to stand the thumb to put the thumb to the power point P1 of the finger putting portion 31.

As it is, the user only performs pushing-down with the thumb in the bending direction of the thumb to push down the finger putting portion 31.

By the way, when the finger abutting portion S is located in front of (inside) the power point P1 of the finger putting portion 31, the user must stand the thumb in a backward-inclined state rather than directly above to put the thumb to the finger putting portion 31 in a state where the user has grasped the grip portion 12.

In this case, for putting the thumb to the finger putting portion 31, thus, the user must arch the thumb in the opposite direction to the naturally bending direction of the thumb in a first stage, and an unnatural state occurs in the finger in view of the function of a joint of the finger.

Further, in this case, even when the user pushes down the finger putting portion 31 in a next second stage, since the user pushes down the finger putting portion 31 in the state where user has arched the thumb, it is also difficult for the user to perform the pushing-down operation.

First Experimental Example

As an experimental example of the feature 2, an experiment was performed while changing the forward inclination angle θ of the finger abutting portion S of the grip portion 12.

Figure 8:
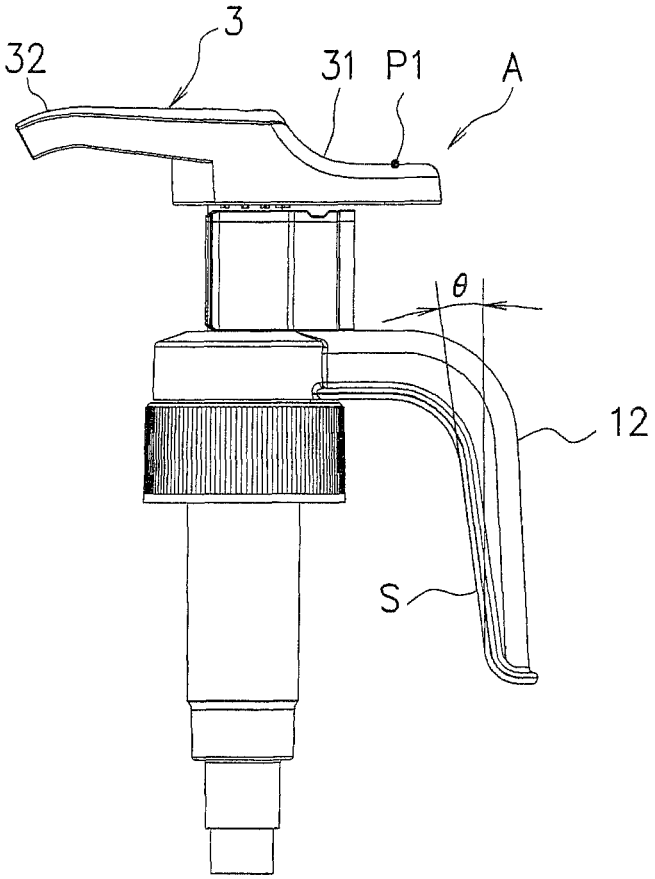
FIG. 8 is a side view of the push-type pump dispenser of the present invention where a paneling test was performed by changing an inclination angle θ of the finger abutting portion.

In a push-type pump dispenser A such as shown in FIG. 8, a paneling test was performed while changing the inclination angle θ of the finger abutting portion S.

The inclination angle of the finger abutting portion S to 43 adult men and women with ordinary figures arbitrarily selected was changed to 1°, 2°, 3°, 4°, 5°, 6°, 7°, 8°, 9°, 10°, 11°, and 12°, so that operability of the push-type pump dispenser A was observed.

It should be noted that the remaining sizes of the finger abutting portion S were as illustrated.

Regarding evaluation of the operability, evaluations based upon five ranks of "easy to operate (◎)", "slightly easy to operate (○)", "no opinion (Δ)", "slightly difficult to operate (□)", and "difficult to operate (X)" when the users pushed down the finger-putting portion 31 were made.

Figures 9A, 9B:
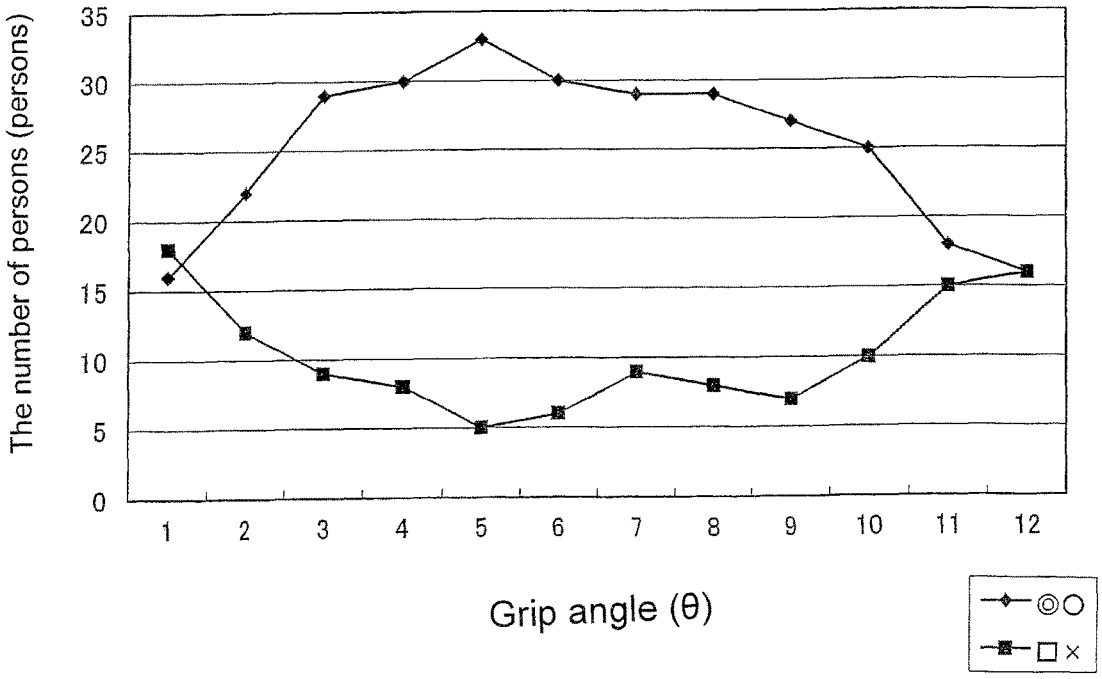
FIGS. 9A and 9B show a result obtained by performing a paneling test while the inclination angle θ of the finger abutting portion was changed in the push-type pump dispenser of the present invention, FIG. 9A being a table of the result and FIG. 9B being a graph thereof.

FIGS. 9A and 9B show the result of the evaluations, FIG. 9A being a table of the result and FIG. 9B being a graph thereof.

As shown by the result in FIGS. 9A and 9B show, it was found that the inclination angle θ of the inclined portion of the finger abutting portion S preferably in a range of 2° to 11°, more preferably in a range of 3° to 10° was excellent from the viewpoint of the operability.

It should be noted that similar experiments were performed by changing the size of the main body but approximately similar tendencies were shown.

Though the first embodiment explained above is the example where the grip portion 12 is provided on the push-type pump dispenser A, it is also possible to provide the grip portion 12 on the container B which is another member like a second embodiment described next.

Validities of an arrangement relationship between a grip portion 12 and the finger putting portion 31 and the inclination angle provided on the finger abutting portion S present on the grip portion 12 also apply to even this case like the first embodiment described above.

It should be noted that, as liquid used in the push-type pump dispenser A of the present invention, for example, cosmetics, liquid detergent, detergent assistant, softener, shampoo, body wash, detergent for tableware, or the like are possible, and it is possible to use these liquids through a dedicated receiving container or a container prepared separately.

Second Embodiment

Figure 10:
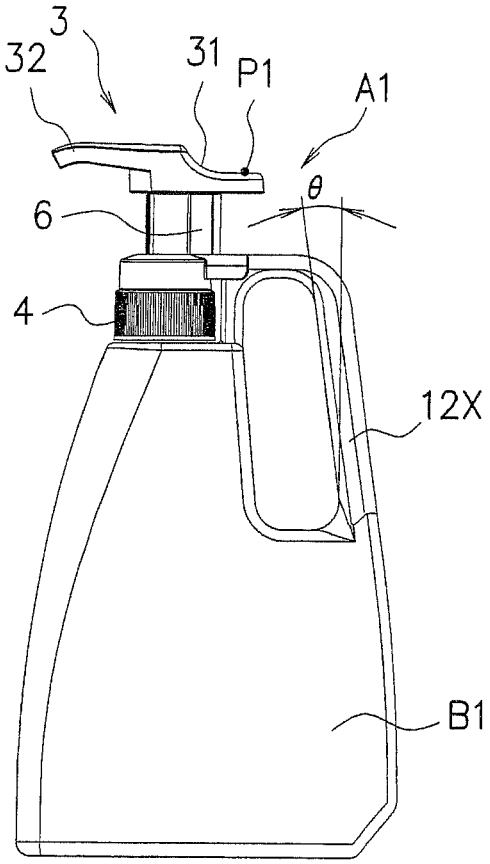
FIG. 10 is a side view showing a push-type pump dispenser of a second embodiment of the present invention.

FIG. 10 is a side view showing a push-type pump dispenser A1 according to a second embodiment of the present invention. It should be noted that FIG. 10 shows a state where the push-type pump dispenser A1 has been attached with the stopper 6.

The push-type pump dispenser A1 is one configured by attaching a push-type pump dispenser which in not provided with a grip portion to a mouth portion of a container B1 having a grip portion.

The push-type pump dispenser A1 attached to the mouth portion of the container B1 corresponds to one obtained by removing the grip portion 12 from the push-type pump dispenser A of the first embodiment, for example.

A case where the push-type pump dispenser attached to the mouth portion of the container B1 is one obtained by removing the grip portion 12 from the push-type pump dispenser A of the first embodiment will be explained below.

In this embodiment, a grip portion 12X is integrally provided on the container B1, but the user pushes down the finger putting portion 31 located above the grip portion 12X to inject liquid within the cylinder portion from the nozzle portion 32 in a state where the user has grasped the grip portion 12X (see FIG. 4 and FIG. 7).

The push-type pump dispenser A1 with a container is provided with a cylinder structure provided with the cylinder portion, a piston structure slidable within the cylinder structure, the nozzle head portion 3 having the nozzle portion 32, and the cap portion 4 like the push-type pump dispenser A of the first embodiment.

It should be noted that a piston guide cylindrical portion which is a portion corresponding to the cylindrical base portion of the first embodiment is provided and it is attached to an upper end portion of the cylinder portion by press fitting.

A point that a guide mechanism is provided between the piston portion and the cylinder portion is also the same as the cylindrical base portion of the first embodiment.

In the push-type pump dispenser A1 with a container, when a user grasps the grip portion 12X of the container B1 with the user's four fingers and puts the user's thumb on the finger putting portion 31 to push down the finger putting portion 31, the piston portion is pushed down together with the piston shaft portion to inject liquid.

Thereafter, the piston shaft portion is pushed up by the return force of the spring portion to return to its original position.

Even in the grip portion 12X of the push-type pump dispenser A1 with a container, a portion on which fingers of a grasping user abut (called "finger abutting portion S") is inclined forward.

It should be noted that a shape of the grip portion 12X is in an L shape and a distal end portion of the grip portion 12X communicates with an intermediate portion of the container, and it is preferable that the inclination angle of the finger abutting portion is preferably set to a range of 3° to 10°.

Therefore, in a state where the user has grasped the grip portion 12X to put the user's fingers to the finger abutting portion S, the user's thumb inclines forward necessarily, so that the user can put the thumb to the finger putting portion 31 easily and is simultaneously prone to push down the finger putting portion 31.

Further, the user is prone to support the whole weight of the push-type pump dispenser A1 including the container B1.

Even in the push-type pump dispenser A1 with a container, a finger abutting portion S of the grip portion 12X provided on the container B1 is wholly set to be located behind (outside) the power point P1 of the finger putting portion 31 provided on the push-type pump dispenser A1.

Therefore, when the user grasps the grip portion 12X to put the user's thumb on the finger putting portion 31, the thumb becomes inclined forward, so that an operation of pushing in a naturally bending direction of the thumb is made possible.

Therefore, no unnaturalness occurs in how to use the finger, so that efficient transmission of a finger force can be achieved.

In addition, since the power point P1 can be set at an intermediate position between the axis of the cylinder portion and the grip portion 12X, the transmission of the pressing can be performed in a dynamically stable state.

It should be noted that, even in the push-type pump dispenser A1 with a container, an experiment similar to that of the first embodiment was performed and verifications of the feature point 1 and the feature point 2 were performed.

As a result, an evaluation result approximately similar to that of the first embodiment was obtained.

That is, it was found that the point that the inclination angle θ of the inclined portion of the finger abutting portion S in a range of 3° to 10° was excellent from the viewpoint of the operability and the case (A) where the whole finger abutting portion S was located behind (outside) the power point P1 of the finger putting portion 31 was excellent regarding the operability.

The present invention has been explained above as the examples of the embodiments, but it is not limited to the above-described embodiments and various modifications of the embodiments can be made possible.

For example, the shape of the grip portion 12 can be made annular, namely, cylindrical.

Figure 11:
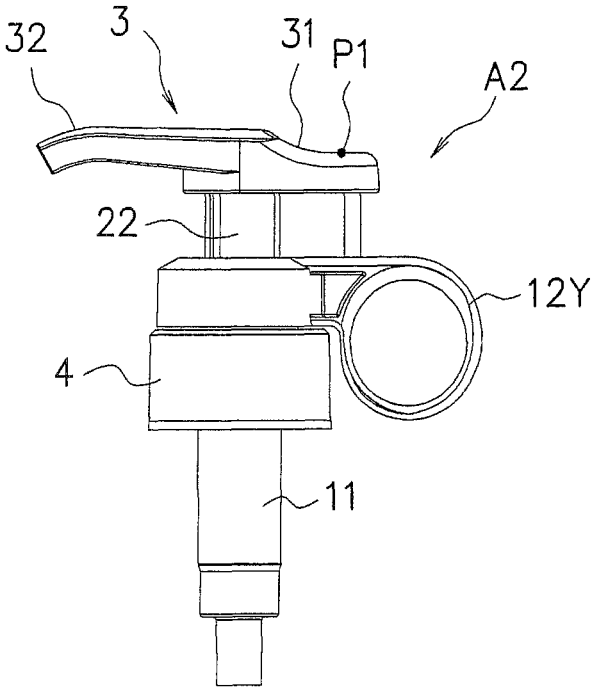
FIG. 11 is a side view showing a push-type pump dispenser having an annular grip portion.

FIG. 11 is a side view showing a push-type pump dispenser A2 where the grip portion is annular (cylindrical).

A point that a finger abutting portion of a grip portion 12Y is located behind the power point of the nozzle head 3 is similar to that of the respective embodiments described above.

By adopting such a shape, it becomes possible for a user to enter the user's second finger into the annular grip portion 12Y to put the user's thumb on the finger putting portion 31 of the nozzle head portion 3 and cause the remaining fingers to abut on a side face of the push-type pump dispenser A2.

In this case, such an effect can be obtained that the fingers become hard to depart.

Further, the push-type pump dispensers described above can also be applied to one of a pressure-accumulating type, and it is possible to attach a known orifice or foaming device at a distal end of the nozzle portion to discharge liquid in a mist fashion or in a foam fashion, of course.

INDUSTRIAL APPLICABILITY

The present invention is a push-type pump dispenser where transmission of a finger force is efficient and operability is excellent, and is a push-type pump dispenser which can be handled easily even by a user with small hands or a powerless user.

Therefore, for example, any push-type pump dispenser using a fluid injecting principle of the present invention can also be sufficiently applied to fields of the whole industries for paint, instruments for beauty treatment, the medical instruments or the like.

REFERENCE SIGNS LIST

1 . . . cylinder structure,
11 . . . cylinder portion,

12, 12Y, 12X . . . grip portion,
12A . . . cylindrical base portion,
12A1 . . . cylindrical space portion,
12A2 . . . vertically-long groove portion,
13 . . . spring portion,
14 . . . leak valve portion,
2 . . . piston structure,
21 . . . piston portion,
22 . . . piston shaft portion,
22A . . . vertical rib portion,
3 . . . nozzle head portion,
31 . . . finger putting portion,
32 . . . nozzle portion,
4 . . . cap portion,
5 . . . tube portion,
6 . . . stopper
A, A1 . . . push-type pump dispenser,
B, B1 . . . container,
S . . . finger abutting portion,
P1 . . . power point,
FV . . . first valve portion,
SV . . . second valve portion.

The invention claimed is:

1. A push pump dispenser that discharges liquid within a cylinder portion from a nozzle head portion by pushing down the nozzle head portion located above a grip portion in a state where the grip portion has been grasped by a user, wherein a finger abutting portion of the grip portion is located behind a power point of the nozzle head portion, the grip portion is formed in an L shape, and an inclination angle of the finger abutting portion is in a range from 3° to 10°, and the push pump dispenser comprises a cylinder portion and the grip portion attached to the cylinder portion, a piston portion slidable within the cylinder portion, a piston shaft portion attached to the piston portion, a nozzle head portion attached to the piston shaft portion, a spring portion for causing the piston portion to return, a cap portion for attaching the cylinder portion to the container, a first valve, and second valve, wherein the nozzle head portion has a nozzle portion in front thereof and includes a finger putting portion largely extending backward, the grip portion has a cylindrical base portion in which the piston shaft portion is inserted to be guided, and the piston portion is moved to apply a pressure to inside of the cylinder portion to discharge liquid through the nozzle portion by pulling down the finger putting portion of the nozzle head portion to cause the finger putting portion to come close to the grip portion.

2. The push pump dispenser according to claim 1, wherein the piston shaft portion has a rib portion in an axial direction thereof, and a vertically long groove portion fitted with the rib portion is provided in the cylindrical base portion of the grip portion.

3. The push pump dispenser according to claim 1, wherein an upper portion of the piston shaft portion is attached to the nozzle head portion by press fitting, and an upper portion of the cylinder portion is attached to the grip portion by press fitting.

4. The push pump dispenser according to claim 1, wherein L magnification of a length (L) of the cylindrical base portion of the grip portion to an outer diameter (R) of the piston shaft portion is in a range of 1 to 3.

5. The push pump dispenser according to claim 1, wherein the cylindrical base portion has a cylindrical space portion for providing an elastic property.

6. The push pump dispenser according to claim 1, wherein the grip portion has a circular shape.

7. A push pump dispenser that discharges liquid within a cylinder portion from a nozzle head portion by pushing down the nozzle head portion located above a grip portion in a state where the grip portion integrally provided on a container has been grasped by a user, wherein a finger abutting portion of the grip portion is located behind a power point of the nozzle head portion, the grip portion is formed in an L shape, and an inclination angle of the finger abutting portion of the grip portion is in a range from 3° to 10°, the push pump dispenser comprises the cylinder portion and a piston guiding cylindrical portion attached to the cylinder portion, a piston portion slidable within the cylinder portion, a piston shaft portion attached to the piston portion, a nozzle head portion attached to the piston shaft portion, a spring portion for causing the piston portion to return, a cap portion for attaching the cylinder portion to the container, a grip portion integrally provided on the container, a first valve, and a second valve, wherein the nozzle head portion has a nozzle portion in front thereof and includes a finger putting portion largely extending backward, and the piston portion is moved to apply a pressure to inside of the cylinder portion to discharge liquid through the nozzle portion by pulling down the nozzle head portion to cause the nozzle head portion to come close to the grip portion.

* * * * *